United States Patent [19]

Massey et al.

[11] 4,240,854

[45] Dec. 23, 1980

[54] FAN-FOLDED LABELING TECHNIQUE

[75] Inventors: Jack W. Massey; William P. Belden, both of Glendora; Ronald A. Mabry, Covina, all of Calif.

[73] Assignee: Avery International Corporation, San Marino, Calif.

[21] Appl. No.: 956,374

[22] Filed: Oct. 31, 1978

[51] Int. Cl.[3] ..... B31F 5/00; B65H 69/06

[52] U.S. Cl. ..... 156/157; 53/429; 53/446; 53/447; 53/442; 53/475; 156/249; 156/541; 206/494

[58] Field of Search ..... 156/157, 249, 502, 541, 156/552, 563; 282/12 A; 206/494; 53/116, 429, 446, 447, 456, 475, 467, 473, 442

[56] References Cited

U.S. PATENT DOCUMENTS

| | | | |
|---|---|---|---|
| 3,285,405 | 11/1966 | Wanderer | 206/494 |
| 3,468,412 | 9/1969 | Forman | 53/442 |
| 3,599,393 | 8/1971 | Read | 53/116 |
| 3,605,378 | 9/1971 | Read | 53/116 |
| 3,631,972 | 1/1972 | Gendron | 206/494 |
| 3,721,601 | 3/1973 | Pituch et al. | 156/541 |
| 3,729,362 | 4/1973 | French et al. | 156/542 |
| 3,776,795 | 12/1973 | Stevenson | 156/157 |
| 3,994,455 | 3/1976 | French | 156/542 |
| 3,997,384 | 12/1976 | Kuring et al. | 156/542 |
| 4,082,595 | 4/1978 | Slater | 156/542 |

FOREIGN PATENT DOCUMENTS

| | | | |
|---|---|---|---|
| 490655 | 2/1953 | Canada | 53/447 |

*Primary Examiner*—Jerome W. Massie

*Attorney, Agent, or Firm*—Poms, Smith, Lande & Rose

[57] ABSTRACT

Self-adhesive labels mounted on a backing strip are formed into fan-folded sets or stacks and are loaded directly from the fan-folding machine into an open four-sided cassette. The cassettes are made of cardboard, and after they are loaded with fan-folded labels, they are enclosed either by the addition of a fifth side or by wrapping. The cassette packages are then transported to the location where labels are to be applied to products moving along a conveyor. The fan-folded labels are supported in an open L-shaped rack which is tilted and which is of sufficient length to hold at least two sets or cassettes of fan-folded labels side by side. The labels are fed directly into a standard type of label dispenser which applies the labels to products as they are moving along a conveyor line. As labels are used up, the free end of the first stack of fan-folded labels may be spliced to the second stack of labels so that the high speed labeling machine does not have to be stopped for re-loading a fresh reel of labels, but the labeling process may continue without downtime.

11 Claims, 9 Drawing Figures

FAN-FOLDED LABELING TECHNIQUE

FIELD OF THE INVENTION

This invention relates to labeling techniques using fan-folded labels.

BACKGROUND OF THE INVENTION

Most normal labeling systems using self-adhesive labels are fed by a supply of labels mounted on a backing strip which is wound up on a reel. With increasing speeds of labeling, and the fact that there is no possibility for splicing a reel until it is fully unwound, the downtime for changing input supply reels becomes a significant portion of the cycle of operation of the labeling system.

Accordingly, an important object of the present invention is to simplify and reduce the downtime of self-adhesive labeling systems.

It has also been proposed to use fan-folded labels, in one case for the labeling of newspapers. However, problems have been encountered in the handling of fan-folded labels as they do not have the inherent stability of a roll of labels mounted on a reel. Accordingly, in the course of transferring the fan-folded labels from the originating machine, into packages, and then in transferring the fan-folded labels from packages into the vertically oriented three-sided racks for holding the labels, some loss and wastage was encountered as piles of labels would fall to the floor or become disarranged from the neat and proper fan-folded stack arrangements.

Accordingly, another important object of the present invention is to provide a simple and reliable system for handling the inherently unstable stacks of fan-folded labels.

SUMMARY OF THE INVENTION

In accordance with a comprehensive view of the present invention, it involves the initial stacking of fan-folded labels into open four-sided cassettes, packaging these four-sided cassettes to prevent shifting of the fan-folded labels, transporting them to the labeling location, and supporting the fan-folded labels in an open L-shaped rack which is long enough to hold at least two stacks of fan-folded labels side by side, and feeding the fan-folded labels directly into the applicator head where they are applied to the products which are moving by the applicator head on a conveyor belt, or the like.

The use of an open cassette to receive the fan-folded labels, and holding the labels in the cassettes until they are ready to be dispensed, represents one feature of the invention.

Another feature of the invention involves the use of the open L-shaped rack for holding two stacks of fan-folded labels as they are ready for supply to the applicator head. The labels may be either left in the cassettes, or slid out into the L-shaped rack, as desired. As mentioned above, the free end from the bottom of the first stack may be spliced to the top end of the second stack of fan-folded labels, thus avoiding the need for downtime which might otherwise be required for changing reels of labels. Also, the use of the open L-shaped rack which is tilted at 45° or 60° relative to the vertical, facilitates the sliding of stacks of fan-folded labels from the open cassettes directly into the open racks without fear of dropping or upsetting the moderately unstable stacks of fan-folded labels; and helps to conveniently support the cassettes when the labels are fed directly from the cassettes.

The simple construction of the four-sided cassettes, which may be made of cardboard or any other suitable sheet material is another aspect of the invention. The cassettes may be made from a simple rectangular piece of sheet material which has a fold along one of the longitudinal sides to establish the height of the cassette, and two transverse slits extending toward the fold but not fully across the sheet. In putting the open sided cassette together, the side portion is folded up and the three remaining flat portions are folded over one another to form a heavy rigid bottom for the cassette which may then be stapled together, if desired. Subsequently, after having been filled with fan-folded labels, the open four sided package may be prepared for transport either by adding one or two additional sides to the cassettes, or by wrapping the four-sided cassettes with transparent shrink plastic material which holds the labels in position in transit.

The use of the special type of cassettes into which the fan-folded labels are deposited as they are made, and from which the labels may be directly withdrawn, is considered to be an important feature of the invention. The bottom end of the label strip may be fed out to the top of the cassette along the side of the cassette to facilitate the splicing of the labels while the labels are fed to the applicator directly from the top of the cassettes. Of course, when the labels are fed directly from cassettes, the configuration and orientation of the rack becomes less critical, and simpler racks or cassette supports may be provided.

Summarizing the advantages of the present invention, it facilitates the use of fan-folded labels to secure the benefits of easy splicing of adjacent stacks of labels, and concurrently avoids the problem of instability in handling stacks of fan-folded labels through the use of the cassettes.

Other objects, features, and advantages of the invention will become apparent from a consideration of the following detailed description and from the drawings.

DETAILED DESCRIPTION

Figure 1:
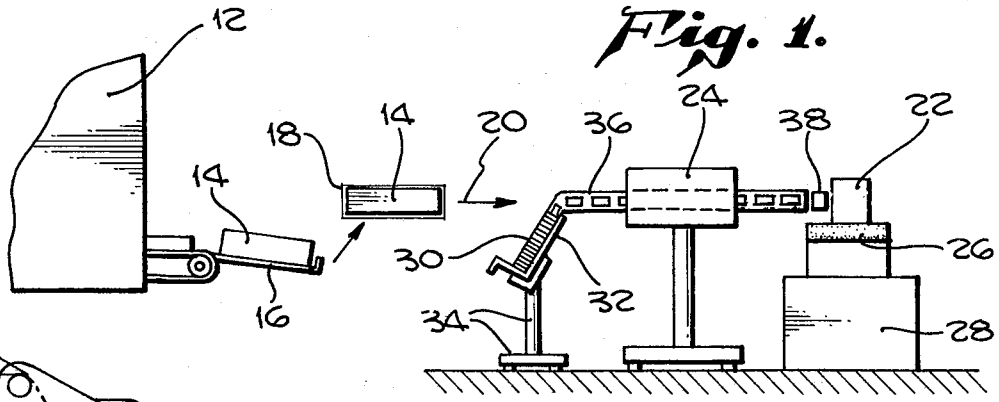
FIG. 1 is a schematic showing of a complete system utilizing the principles of the present invention.

Referring more particularly to the drawings, FIG. 1 is a schematic showing of a complete system illustrating the method of the present invention, from the fabrication of the stacks of fan-folded labels and their direct loading into cassettes, to the final application of the self-adhesive labels to the product.

Initially, by way of background, labels are customarily applied to bottles, boxes, or other products by the initial arrangement of a continuous row of self-adhesive labels on a backing strip. These labels are removed from the backing strip by running the strip over a peeling blade where the backing strip is bent back sharply over onto itself, and the label continues to move forward. As the label moves forward, it is either picked up by a vacuum applicator, or is directly rolled onto the product to which it is to be affixed. All of this is well known in the applicator field.

In recent years, as the speed of application of labels has progressively increased, the method of supplying labels to an applicator on reels and the periodic changing of the reels to provide a new supply of labels, has required the stopping of the labeling conveyor line and the applicator apparatus while the reels are being changed. Further, as can be appreciated, with higher speeds of labeling, the reels of labels are used up more quickly, and the time required for changing and splicing rolls of labels causes a higher percentage of downtime than under previous conditions when the applicator operated at a slower rate. The present system as shown in FIG. 1 schematically, and in the remaining figures in more detail, involves the use of fan-folded labels to avoid this downtime, and also includes techniques for avoiding the instability associated with stacks of slick surface fan-folded labels.

Now, turning back to FIG. 1, a conventional fan-folded label fabrication machine 12 dispenses labels directly into an open four-sided box or cassette 14, which is held in its proper position by an output rack 16. After the open cassette is filled, it is packaged to hold the labels in place. This may be accomplished by adding a top to the cassette, or by shrink packaging through the application of an outer film of plastic 18 which is rapidly heated by a known process and shrinks tightly around the cassette 14 to hold the enclosed labels firmly in place. The cassettes are then transported to the location where the labels are to be applied to products, as indicated by the arrow 20.

At the label application point, the successive products 22 are moved past a labeling applicator 24 by a conveyor 26 mounted on a base 28. The fan-folded labels 30 may be slid directly from the cassette 14 into the open L-shaped rack 32 which is mounted on a base 34. The tape 36 to which the labels are secured is suitably guided between the rack 32 and the applicator 24 until the tape passes over the peeling blade 38 at which point the labels are dispensed and secured to the products 22.

Figure 2:
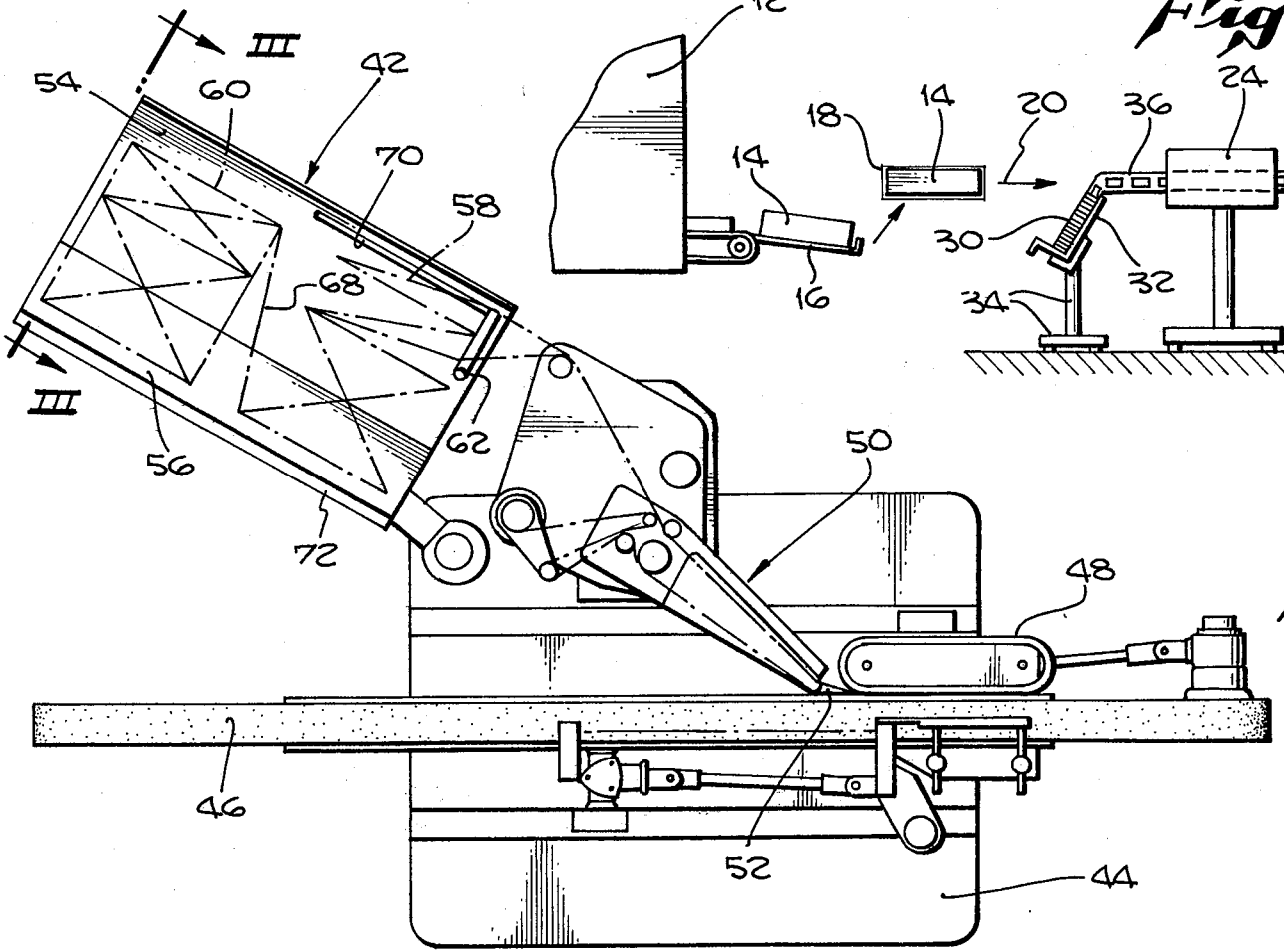
FIG. 2 is a top view of an integrated standard machine employing fan-folded labels in accordance with the principles of the invention.

FIG. 2 is a top view, which with the exception of the fan-folded labeling rack 42, is an Avery Universal-type labeling machine available from Avery Label Company, 777 East Foothill Boulevard, Azusa, Calif. 91702. The apparatus is also described in a patent application assigned to the assignee of this case, entitled "Universal Labeling Apparatus", Ser. No. 921,957, filed July 5, 1978.

Summarizing, the principal units which make up the universal machine of FIG. 2 are the base 44, the conveyor belt 46 by which the products are carried down the length of the machine, the wrap belt 48 by which labels are wrapped onto the products moving down the conveyor 46, and the standard Type 500 Avery Labeling head 50 which is usually equipped with reels to supply labels, rather than by fan-folded labels. The peeling blade 52, by which the labels are dispensed from the backing tape adjacent the wrap belt 48, is also worthy of note. The other details of the Universal Labeling System have been described previously and involve a commercially available apparatus, so will not be described further at this point.

The applicator 24 as shown in FIG. 1 may be the same Type 500 Avery Labeling head, separately mounted for use with a customer's conveyor line rather than as part of the universal machine as shown in FIG. 2.

Figure 3:
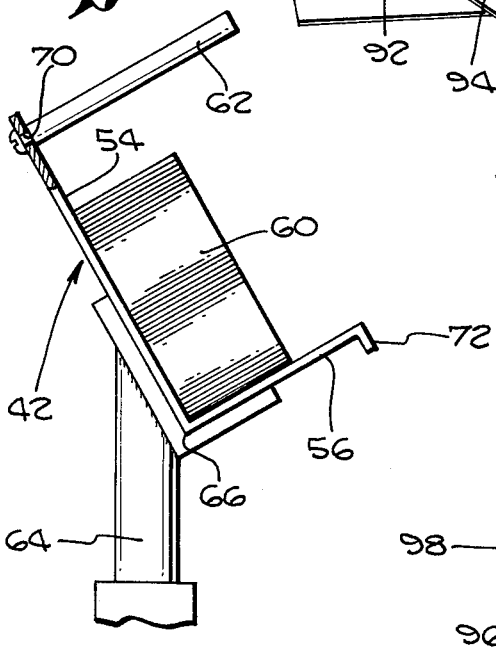
FIG. 3 is a partial view taken along lines III—III of FIG. 2.

As shown in FIG. 2, and also in FIG. 3 which is taken along III—III of FIG. 2, the rack 42 is generally L-shaped in configuration and includes two sides 54 and 56 which are tilted so that the stacks of fan-folded labels 58 and 60 may easily be slid directly from the four-sided cassettes into the rack 42. A drag post 62 is provided to assist in guiding the web as it leaves the rack 42 and is fed into the applicator 50. The rack 42 is mounted on the support post 64 at an angle with the sides 54 and 56 both going upward from their junction point 66, so that the two stacks of fan-folded labels are stably maintained in their desired locations ready for feeding into the applicator head 50. Between the two stacks of fan-folded labels 58 and 60 is shown a splice 68 between the lower end of the web from the bottom of stack 58 and the upper end of the web from stack 60. Subsequently, when all of the labels in stack 58 are used up, the stack 60 is slid across to the right as shown in FIG. 2, a new stack of labels is slid from another cassette into place in the rack 42, and the splicing operation is repeated.

The drag post 62 is provided with a mounting slot 70 to permit the adjustable positioning of the drag post. One or both of the two sides 54, 56 of the L-shaped rack 42 may be provided with a lip 72 to provide increased rigidity and strength, and to avoid possible injury to persons as they are loading and splicing the stacks of fan-folded labels.

Figure 5:
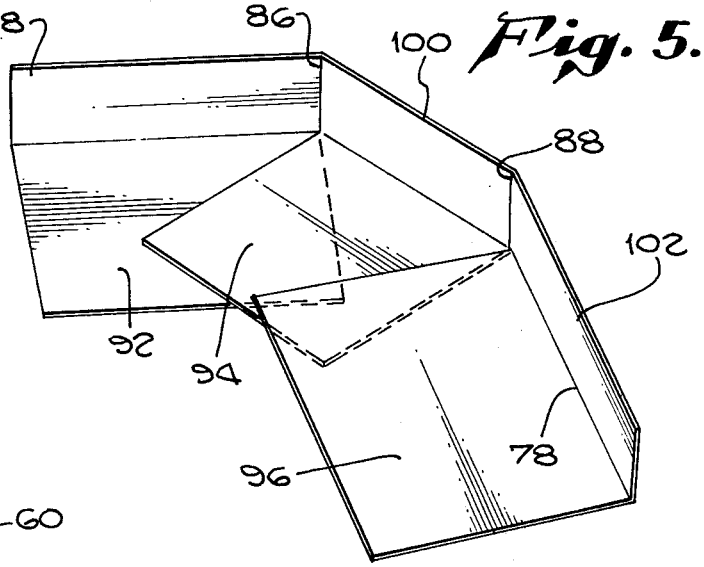
FIGS. 4, 5 and 6 are successive views showing the construction of a cassette for holding fan-folded labels.
Figure 6:
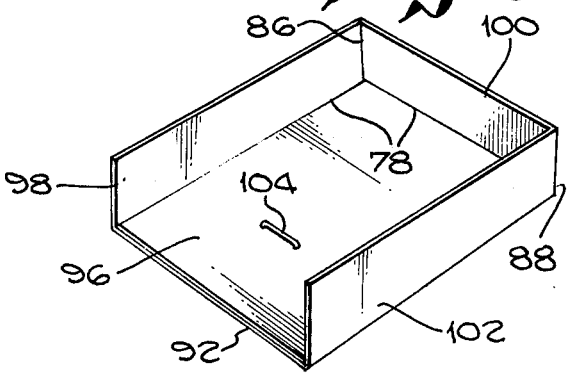
Figure 4:
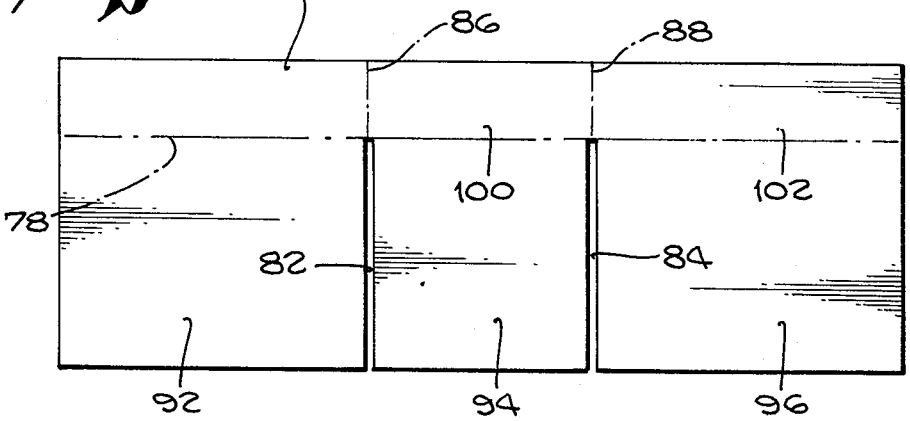

FIGS. 4, 5, and 6 show successive steps in the fabrication of the open cardboard box or cassette 14 for holding the fan-folded labels. FIG. 4 shows the initial step in the fabrication of the cassette from a substantially rectangular piece of cardboard or other suitable sheet material. Initially, the rectangular piece of cardboard is provided with a heavy longitudinal score or pre-bending line 78, several lighter scores or bending lines 80, and two cuts 82 and 84 which terminate at fold line 78 and in two heavy fold lines 86 and 88. The next step in forming the cassette is shown in FIG. 5 in which the three large flat areas of the sheet material 92, 94 and 96 are interleaved after the sheet material is folded along line 78 to form the upstanding three vertical sides of the cassette 98, 100 and 102. The completed box is shown in FIG. 6 with the area 96 forming the top layer of the bottom of the cassette. The three layers of the bottom may be held together in any suitable manner such as by a staple 104 as shown in the center of the area 96 in FIG. 6.

Figure 7:
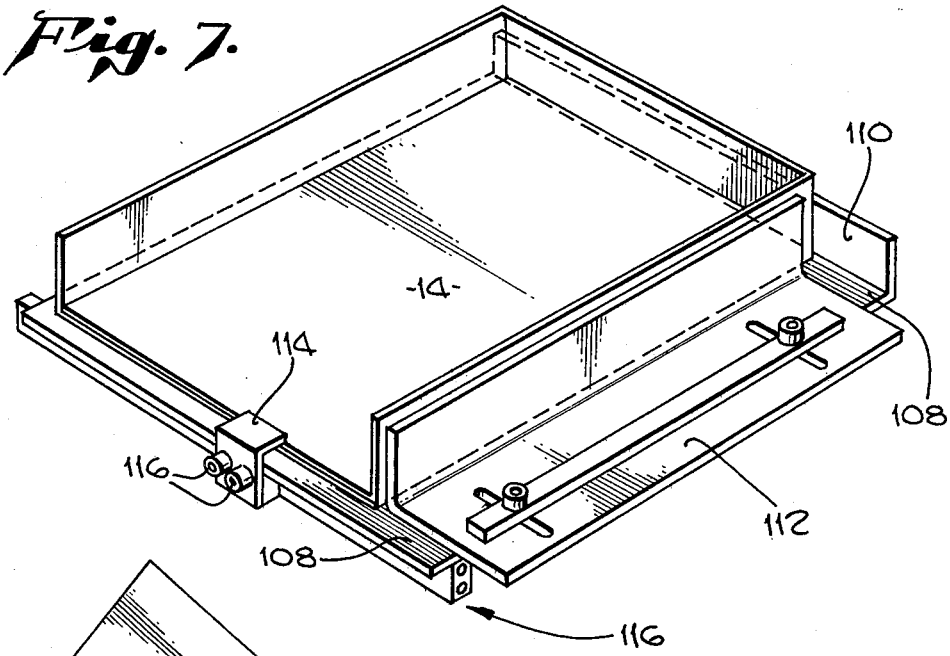
FIG. 7 shows an open cassette for receiving the fan-folded labels mounted at the output from a fan-folded label fabrication machine.

FIG. 7 is an enlarged showing of the rack 16 at the output of the fan-folded label fabrication machine 12, referring back to FIG. 1. Incidentally, the machine 12 is a commercially available machine available from B. Bunch Co., 9619 N. 21st Drive, Phoenix, Ariz. 85021, and is designated as the Bunch 600 Series type machine. The rack 16 is located at the output from the Bunch 600 type machine and includes a support tray 108 with a rear vertically extending stop 110. The cassette 14 is held in position by the rear plate 110, the adjustable side plate 112 and a removable cassette clamp 114 which may be held in place by the two machine screws 116. Once the cassette is in place, the labels are transferred directly from the machine 12 into the cassette 14, without the need to transfer the unstable and slippery stacks of fan-folded labels by hand, thereby avoiding the problem of possible disarrangement of the stacks.

Figure 8:
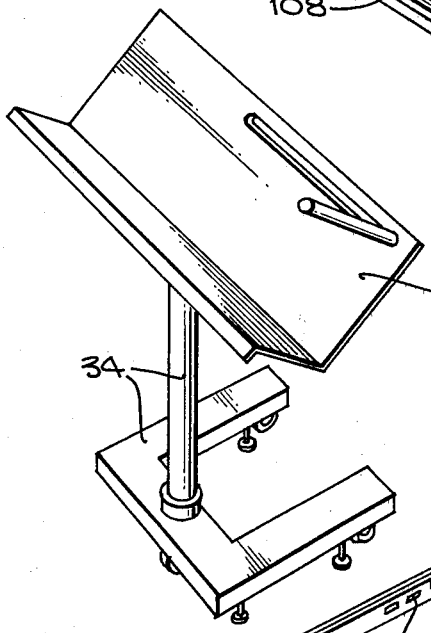
FIG. 8 shows a rack for holding two stacks of fan-folded labels.

FIG. 8 is an enlarged view of the rack 32 and the separate support 34 as shown in FIG. 1. The rack 32 is substantially as shown in FIGS. 2 and 3 for the rack 42, with the exception that rack 42 was mounted as an integral part of the Universal Machine, while rack 32 as shown in FIG. 8 is a separate free-standing unit. On a more general basis, the Universal Machine arrangement as shown in FIG. 2 is employed when a complete installation including the conveyor is supplied. On the other hand, when the customer has an existing conveyor, and only wishes an applicator head and the rack for fan-folded labels, then free-standing units may be provided, including a free-standing rack for the fan-folded labels as shown in FIG. 8. In accordance with present practice for free-standing units supplied by the assignee of the present invention, suitable rollers as well as firm support arrangements may be employed for the base 34.

Figure 9:
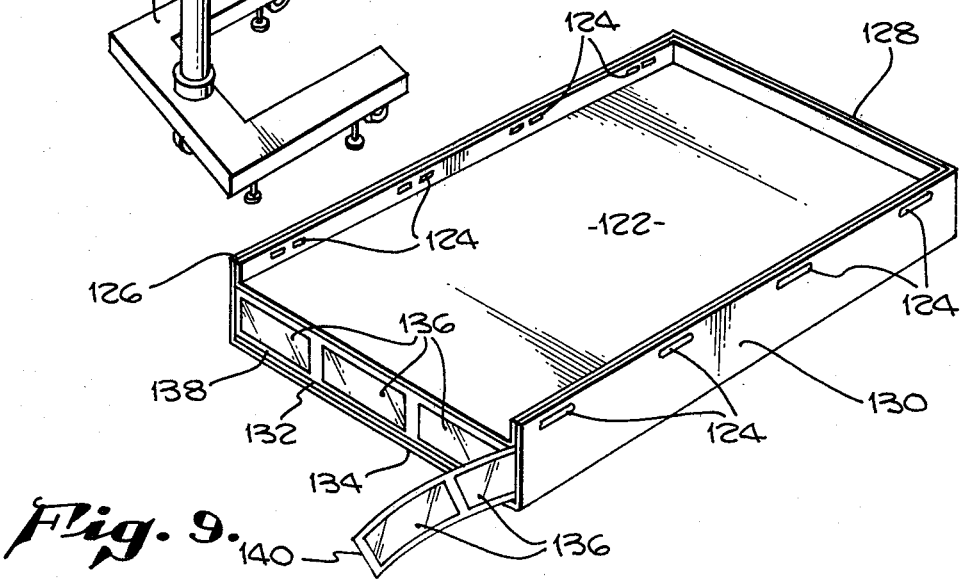
FIG. 9 shows an alternative form of cassette for the fan-folded labels.

FIG. 9 shows an alternative style of cassette which is similar to that shown in FIGS. 4, 5 and 6, with the exception that, following loading with fan-folding labels, a top 122 is stapled by staples 124 into the upper edges of the three sides 126, 128 and 130. As in the case of the cassette shown in FIGS. 4, 5 and 6, the cassette of FIG. 9 is made from a flat rectangular piece of sheet material such as cardboard, and the three overlying surfaces form the bottom, of which the two layers 132 and 134 are visible in FIG. 9. The front layer of the stack of fan-folded labels is clearly visible, with the first three labels being identified by reference numeral 136 and the tape or web for carrying labels 136 being identified by the reference numeral 138.

When cassettes of the type shown in FIG. 9 are employed, they may be mounted directly on the racks such as those shown in FIGS. 1, 2 and 8, without removing the stack of fan-folded labels from the cassette. The fan-folded labels are then fed directly from the cassettes, and each of the racks is broad enough to accommodate at least two cassettes. As in the case of the previously disclosed arrangements, the fan-folded labels in the two successive cassettes may be spliced together before the labels in the first cassette are used up. This is accomplished by bringing the end of the fan-folded tape up along one side 130 of the cassette from its normal position adjacent the end 128 so that it extends out the front end of the cassetts, as indicated at 140 in FIG. 9. Then, while the labels 136 are being fed from the top of the stack of the fan-folded labels, the end 140 may be spliced to the fan-folded labels from the top of another cassette which will be loaded on the rack immediately adjacent the cassette as shown in FIG. 9.

Strictly by way of example, and not of limitation, certain representative dimensions for the cassettes will be given. In general, the labels are uniformly spaced along the length of the supporting web or tape, and the tape is preferably bent to its fan-folded configuration between labels. Accordingly, the width of the opening of the cassette is largely determined by the distance between a whole number of labels. A convenient length is normally between about 7 and about 14 inches. The height of the portion of the cassette in which the fan-folded labels are stored is determined by the height of the label, in general. Of course, in the arrangement of FIG. 9, the sides of the cassette extend up beyond the height of the labels to facilitate the securing of the lid or upper side 122 by the staples 124. The depth of the cassettes may vary, and are chosen to provide a convenient package for handling and a weight which will be readily supported by the racks which are employed in the installation which is being used. In one case in which cassettes of the type shown in FIG. 9 were used, the size of the cassettes was three inches by 8 inches by 18 inches long, with the portion of the cassette in which the fan-folded labels were stored being only 2 inches in height and with the extra inch being employed for stapling the top in place following fitting of the cassette. In one representative cassette using the construction shown in FIGS. 4, 5, and 6, the cassette size was approximately 13 inches by 4 inches by 18 inches.

It may also be noted that, when the labels are supplied to the applicator directly from cassettes of the type shown in FIG. 9, the cassettes may be supported more simply, and without the tilt and the drag post shown in the rack 42 and 32 of FIGS. 1, 2 and 8.

In closing. it is to be understood that the foregoing description related to illustrative embodiments of the invention only, and that other arrangements are within the scope of the present invention. Thus, by way of specific example, instead of the open four-sided cassette a suitable five or six-sided cassette arrangement with one or two sides capable of being folded back out of the way during loading and/or unloading, so that the cassette is open to freely receive the labels as they are fed out of the fan-folding machine, would also be within the scope of the present invention. Similarly, other fan-folding label fabrication machines and different types of label applicators could be employed in the place of specific arrangements disclosed herein. Accordingly, the present invention is not limited to the exact arrangements shown herein.

What is claimed is:

1. A method for efficiently handling slippery and unstable layers of fan-folded self-adhesive labels mounted on a backing sheet comprising the steps of: p1 preparing self-adhesive labels on a backing tape in a fan-folded configuration to form a slippery and unstable stack of layers;

loading stacks of the slippery fan-folded labels on backing tape directly from a fan-folding label fabrication machine into rectangular four sided cassettes open at both the front and the top;

packaging the loaded cassettes to hold the fan-folded labels in the cassettes;

transporting the cassettes to the label applicator location;

mounting first and second stacks of fan-folded labels adjacent one another with the lower end of the backing tape and labels of each fan-folded stack available for splicing;

feeding said labels from the first one of said stacks into a label applicator;

applying said labels from said applicator to products as they are moving along a conveyor; and splicing the lower end of said first stack to the upper end of said second stack of fan-folded labels without interrupting the dispensing and application of labels from the top of said first stack of fan-folded labels.

2. A high efficiency labeling method as defined in claim 1 wherein said fan-folded labels are loaded into said open cassette from the top and front of said cassette, and wherein the top of said cassette is subsequently covered to facilitate transporting said labels to the labeling applicator location.

3. A high efficiency labeling method as defined in claim 1 wherein a top is located on each cassette following loading.

4. A high efficiency labeling method as defined in claim 3 wherein said top is stapled onto the top of said cassette.

5. A high efficiency labeling method as defined in claim 3 wherein the lower end of said tape is threaded out the open end of said cassette prior to locating the top on said cassette.

6. A high efficiency labeling method as defined in claim 1 wherein said stacks of fan-folded labels are slid out of said cassettes into an open label dispensing rack of L-shaped cross-section.

7. A high efficiency labeling method as defined in claim 6 wherein said labels are mounted into the rack with the rack at a significant angle from the vertical to hold said stacks of labels in position in said rack by the force of gravity exerted toward both of the sides of said L-shaped rack.

8. A high efficiency labeling method as defined in claim 1 wherein said stacks of labels are mounted into an L-shaped rack adjacent said label applicator.

9. A method for efficiently handling slippery and unstable layers of fan-folded self-adhesive labels mounted on a backing sheet comprising the steps of:

preparing self-adhesive labels on a backing tape in a fan-folded configuration to form a slippery and unstable stack of layers;

loading stacks of the slippery fan-folded labels on backing tape directly from the fan-folding label fabrication machine into rectangular four sided cassettes open at the top and the front;

packaging the loaded cassettes to hold the fan-folded labels in the cassettes by using shrink wrap plastic covering;

transporting the cassettes to the label applicator location;

removing the shrink wrap plastic covering;

mounting first and second stacks of fan-folded labels adjacent one another in a tilted L-shaped rack with the lower end of the backing tape and labels of each fan-folded stack available for splicing;

feeding said labels from the first one of said stacks into a label applicator;

applying said labels from said applicator to products as they are moving along a conveyor; and splicing the lower end of said first stack to the upper end of said second stack of fan-folded labels without interrupting the dispensing and application of labels from the top of said first stack of fan-folded labels.

10. A labeling method as defined in claim 9 wherein two of said cassettes are placed directly on said tilted L-shaped rack, whereby said labels are held in said cassette from the time the fan-folded labels and backing tape come out of the fan-folding fabrication machine until they are fed to the label applicator, and whereby the stack or fan-folded labels on backing tape is never handled apart from the cassette.

11. A method as defined in claim 9 wherein said fan-folded labels and backing tape are formed with the width of each fan-folded section of tape being less than one-half the length of each section, and said labels are loaded into said cassettes to a depth which is greater than the length of each fan-folded section of tape.

* * * * *

UNITED STATES PATENT AND TRADEMARK OFFICE

CERTIFICATE OF CORRECTION

PATENT NO. : 4,240,854

DATED : December 23, 1980

INVENTOR(S) : Jack W. Massey et al.

It is certified that error appears in the above-identified patent and that said Letters Patent are hereby corrected as shown below:

Claim 1, column 6, line 41, delete "pl" at the end of the line; in line 42 start a new paragraph with the word "preparing".

Signed and Sealed this

*Twenty-fourth* Day of *March 1981*

[SEAL]

*Attest:*

RENE D. TEGTMEYER

*Attesting Officer*

*Acting Commissioner of Patents and Trademarks*